US006648447B2

(12) United States Patent
Sugimoto et al.

(10) Patent No.: US 6,648,447 B2
(45) Date of Patent: Nov. 18, 2003

(54) INK-JET RECORDING APPARATUS AND EJECT RECOVERY METHOD

(75) Inventors: Hitoshi Sugimoto, Kanagawa (JP); Takeshi Yazawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/984,424

(22) Filed: Oct. 30, 2001

(65) Prior Publication Data

US 2002/0060712 A1 May 23, 2002

(30) Foreign Application Priority Data

Nov. 1, 2000 (JP) ..... 2000-334517

(51) Int. Cl.[7] ..... B41J 2/165
(52) U.S. Cl. ..... 347/30; 347/23; 347/29
(58) Field of Search ..... 347/30, 14, 23, 347/29, 32

(56) References Cited

U.S. PATENT DOCUMENTS 4,893,138 A * 1/1990 Terasawa et al. ..... 347/30
4,999,643 A * 3/1991 Terasawa ..... 347/30
5,701,146 A 12/1997 Akiyama et al. ..... 347/26
5,896,143 A 4/1999 Matsui et al. ..... 347/24
6,079,809 A 6/2000 Yaegashi et al. ..... 347/35
6,145,956 A 11/2000 Koitabashi et al. ..... 347/30
6,179,404 B1 1/2001 Kawarama et al. ..... 347/31
6,447,095 B1 * 9/2002 Kanda et al. ..... 347/30

FOREIGN PATENT DOCUMENTS

EP 0 850 765 A2 * 7/1998
JP 3-61593 3/1991
JP 5-201029 8/1993

* cited by examiner

*Primary Examiner*—Shih Wen Hsieh
(74) *Attorney, Agent, or Firm*—Fitzpatrick, Cella, Harper & Scinto

(57) ABSTRACT

An ink-jet recording apparatus having first eject ports for ejecting a first ink and second eject ports for ejecting a second ink, a cap for capping the first and second eject ports, a sucking device which sucks ink while the cap is capping the first and second eject ports, a controlling device which controls the sucking device to suck the first and second eject ports via the cap when a communicating valve is closed, then opens the communicating valve as the cap is capping over eject ports and sucks against the cap by the sucking device, and ejects ink into the cap from the first and second eject ports simultaneously.

10 Claims, 8 Drawing Sheets

INK-JET RECORDING APPARATUS AND EJECT RECOVERY METHOD

BACKGROUND OF THE INVENTION

1. Field of the Invention

The present invention relates to an ink-jet recording apparatus including an eject recovery device of a recording head, which executes recording operations as ejecting liquid for recording, and relates to an eject recovery method.

2. Brief Description of the Related Art

An ink-jet printer, widely known as an image forming apparatus, is generally equipped with an eject recovery device for removing thickened ink, foreign particles and the like stuck to an eject port forming surface on its recording head so as to keep a stable ejecting performance of the ink-jet printer. The eject recovery device comprises one or a plurality of caps for covering an eject port forming surface of the recording head during non-printing operations to prevent ink as a liquid for recording from drying or evaporating, and a pump for sucking the thickened ink from and around the eject port forming surface via the cap.

Japanese published patent No. 03-61593 discloses a conventional ink-jet recording apparatus where an eject recovery operation is executed as a cap is being closely attached to the conventional recording head. A sucking ink operation described in this published patent is executed as follows: The cap is closely attached to an eject port surface of the recording head. A negative pressure is generated inside of the cap so that ink in the recording head is sucked via nozzles. Then ink remaining inside the cap is sucked as the inside of the cap is being communicated to the atmosphere. Finally the cap is detached from the recording head. Thus a series of recovery operations are executed.

The above-mentioned published patent discloses effects of preventing air from penetrating into nozzles and preventing ink from dripping/scattering from the cap, but does not imply anything about a "mixed color", a problem to be solved by the present invention.

The above-referred invention also proposes an absorbent arranged inside the cap, which attains effects of removing stagnant ink stuck around nozzles by sucking, and reducing remaining ink around eject port surface.

Ink-jet recording apparatuses employing color inks have been increasing, where a plurality of color inks are respectively ejected and a plurality of color ink dots are controlled in accordance with colors to be reproduced.

When a plurality of color ink tanks are mounted on the recording head equipped with a color cartridge where a plurality of nozzle rows for respective colors or a plurality nozzle groups for respective colors arranged on one nozzle row, usually caps for respective colors are not arranged, but one or the smaller number of caps than the color number to cover a plurality nozzle rows or nozzle groups are arranged so as to simplify a sucking mechanism and reduce a production cost of the apparatus.

When color printings are executed by the ink-jet recording apparatus, generally three colors Y, M and C (respectively mean yellow, magenta and cyan) and a black ink (Bk), namely 4 colors are employed. It is possible to print the black color by using three colors, Y, M and C, but usually the black ink is additionally employed so as to print a vivid black. When a first recording head to record in black ink and a second recording head to record in color inks are arranged in the ink-jet recording apparatus for this purpose, a first and a second caps for respective recording heads are required. Sometimes the first and second caps having the same capping mechanism are arranged respectively. Alternatively the first and second caps are constituted as a one-pieced member.

However, in conventional examples mentioned above, a plurality of inks mix each other and form a turbid ink which fills inside the cap, when the sucking operation is executed. Even after the cap is detached from the eject port forming surface of the recording head, the remaining turbid ink stuck to the eject port forming surface is mixed with ink inside nozzles. Which causes a problem of the so called "mixed color phenomenon" such that light colors such as yellow and the like are contaminated by the remaining turbid ink, when recording is performed on a recording medium. Since a pressure inside the ink tank is set always lower than that in nozzles, remaining mixed ink on the eject port surface of the recording head is sucked into the recording head via nozzles and finally is reversely flowed further inside the recording head.

As a trial to prevent the mixed color phenomenon, ink, not for recording, is ejected to remove the mixed ink in the nozzles. Japanese registered patent No. 2615619 discloses the ink ejection for preventing the mixed color phenomenon. The following procedure is described in the patent: ink is ejected for preventing mixing inks as a sucking pump is being driven, while the cap is detached from the recording head after the sucking operation.

To eject ink from nozzles during non-printing operations by driving the recording head, is sometimes referred as "pre-ejection". The pre-ejection is executed when removing thickened, stagnant bubbles and foreign particles in the nozzles to maintain ejecting stability, as well as when ejecting the mixed ink penetrated into the recording head.

However, when the cap is detached from the recording head after the sucking operation as ink is remaining in the cap, the following problem is remained unsolved. The predetermined amount of pre-ejection is not enough for ejecting mixed ink completely owing to ink properties and various conditions in water repellent status on the eject port surface of the recording head, consequently a fairly amount of ink must be wasted for the pre-ejection the following cases. (1) A large amount of ink is left at the recording head after detaching the cap from the recording head. (2) A large negative pressure (holding pressure) inside of the ink tank mounted on the recording head causes the more aggravated "mixed color phenomenon" due to a large amount of flowing mixed ink into nozzles.

In a sucking operation of a cap having a communicating valve to the atmosphere, when the communicating valve is opened to the atmosphere and cap is detached after ink inside the cap is removed after the sucking operation, a fairly large amount of ink must be pre-ejected for eliminating the mixed color completely, since the mixed ink in the nozzles diffuses further into the inside the recording head during a time between the sucking and detaching the cap.

The Japanese laid open patent No. 05-201029 discloses an arrangement having caps for respective colors, where inks are pre-ejected in the caps as being capped over the recording head by operating a piston pump, but it does not suggest anything about the mixed color.

SUMMARY OF THE INVENTION

The present invention is carried out in view of the above-mentioned situations to provide the ink-jet recording apparatus and the eject recovery method capable of eliminating a problem that a large amount of ink is wasted by the pre-ejection for preventing the mixed color phenomenon.

The present invention having the following constitutions solves the above-mentioned problems.

(1) An eject recovery method comprising steps of: a first step for performing suction from a first eject port for ejecting first ink and a second eject port for ejecting second ink different from the first ink through a cap for capping the first eject port and the second eject port while the cap is capping the first eject port and the second eject port collectively; and a second step for communicating an inside of the cap to atmosphere while the cap is capping the first eject port and the second eject port, and then performing suction from the cap while the inside of the cap communicating to atmosphere and while the cap is capping the first eject port and the second eject port, and concurrently ejecting ink into the cap from the first eject port and the second eject port.

(2) The eject recovery method according to (1), where the first ink and the second ink are different in colors.

(3) The eject recovery method according to (1), further comprising a third step for releasing the capping status by the cap after the second step.

(4) The eject recovery method according to (3), further comprising a fourth step for sucking from the cap as the capping status by the cap is being released after the third step.

(5) The eject recovery method according to (1), where the ink ejection into the cap starts after a predetermined time elapses after the sucking from the cap starts during the second step.

(6) An ink-jet recording apparatus comprising: a cap for capping a first eject port for ejecting first ink and a second eject port for ejecting second ink different from the first ink collectively, and equipped with a communicating valve to atmosphere; a sucking means for performing suction while the cap is capping the ink eject ports; and a control means for causing the sucking means to perform suction from the first eject port and the second eject port through the cap while the cap is capping the first eject port and the second eject port collectively, then causing the valve to communicate an inside of the cap to atmosphere while the cap is capping the first eject port and the second eject port, and thereafter causing the sucking means to perform suction from the cap while the inside of the cap communicates to atmosphere and while the cap is capping the first eject port and second eject port and concurrently ejecting ink into the cap from the first eject port and the second eject port.

(7) The ink-jet recording apparatus according to (6), where the first ink and the second ink are different in colors.

(8) The ink-jet recording apparatus according to (6), where the control means starts ejecting ink into the cap after a predetermined time elapses after the sucking from the cap starts.

(9) The ink-jet recording apparatus according to (6), where an absorbent is arranged inside the cap.

(10) The ink-jet recording apparatus according to (6), where electro-thermal converting bodies for generating thermal energy to be utilized to eject ink are arranged corresponding to the respective first eject port and second eject port.

DETAILED DESCRIPTION OF THE PREFERRED EMBODIMENTS

Hereinafter embodiments according to the present invention are explained by referring to drawings.

Figure 1:
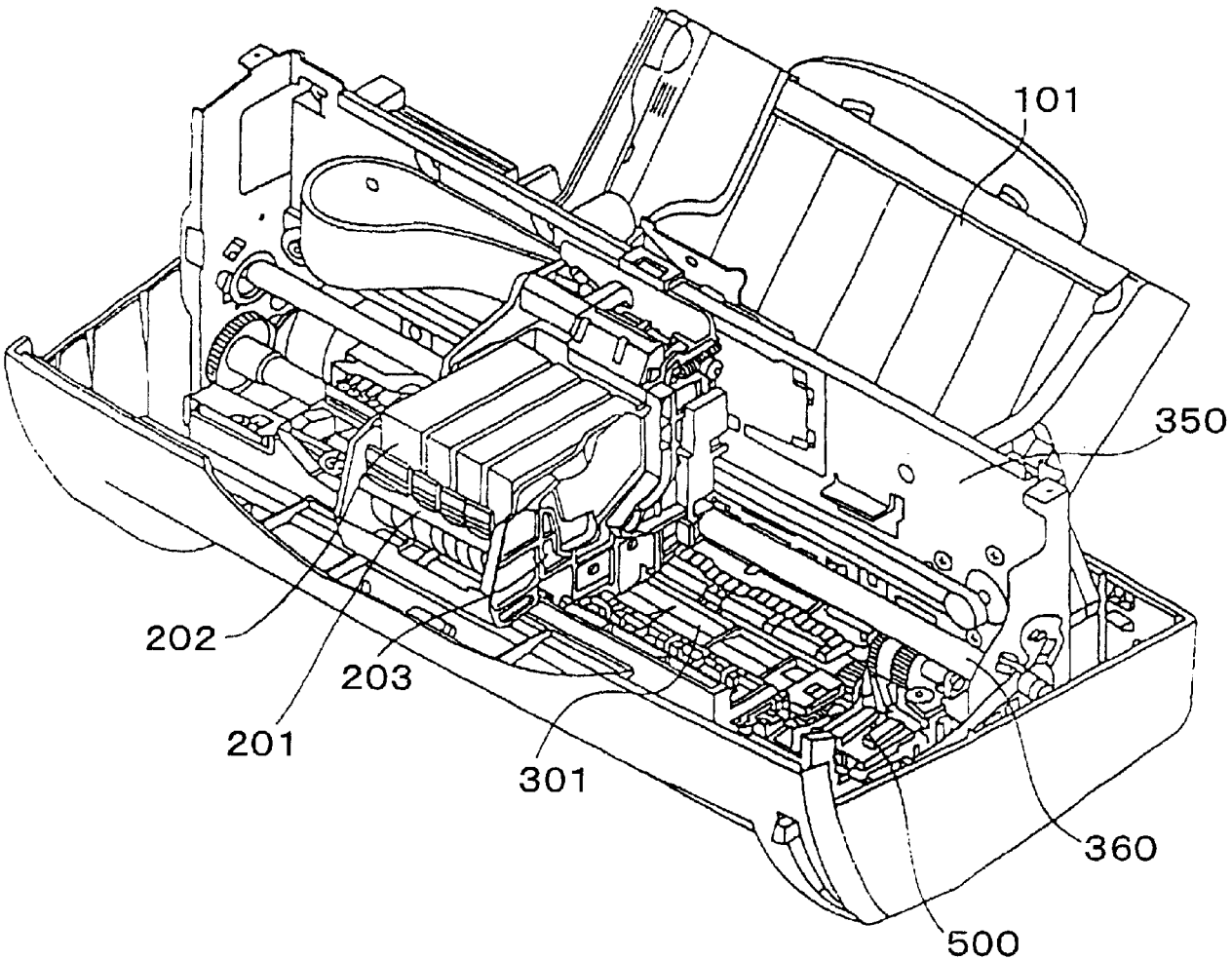
FIG. 1 is a perspective view of the ink-jet printer as an example of image forming apparatuses according to the present invention.

FIG. 1 is the perspective view showing the ink-jet printer with the upper cover removed, as the example of image forming apparatuses according to the present invention.

A sheet (a medium to be recorded) mounted on a paper supply tray 101, is supplied by revolving paper supply rollers (not shown in FIG. 1) and fed onto a platen 301 by feeding rollers (not shown in FIG. 1). While the sheet is being fed, a image recording (forming) operation and the like is executed by ejecting ink from the recording head mounted on a carriage 203 onto the sheet in accordance with scanning movements of the recording head.

The above-mentioned recording head 201 and an ink tank 202 where ink is stored for supplying ink to the recording head, are detachably mounted on the carriage 203. The carriage 203 is slidably fitted to a scanning rail 360 supported by a chassis 350 so as to scan the above-mentioned recording head by transmitting a driving force from a carriage motor (not shown in FIG. 1) via a transmitting mechanism such as a belt. At the one end of scanning region of the carriage 203, a recovery unit 500 is arranged for executing eject recovery treatments so as to maintain good ejecting performances of the recording head 201.

As mentioned above the recording head 201 and the ink tank 202 are detachably mounted on the carriage 203, in the present embodiment, however, a tank holder equipped with the ink tank 202 is mounted on a holder monolithically formed with the recording head 201, which is integrally mounted on the carriage 203. The above-mentioned recording head 201 and ink tank 202 are arranged such that recordings by inks i.e. black, cyan, magenta and yellow are executed respectively. Further the recording head 201 of the present embodiment employs the so-called bubble jet method, where a pressure caused by bubbles generated in ink by utilizing thermal energy so as to eject ink. In order to supply thermal energy for generating bubbles to eject ink, the above-mentioned recording head 201 is equipped with electro-thermal energy conversion modules (not shown in FIG. 1).

Figure 2:
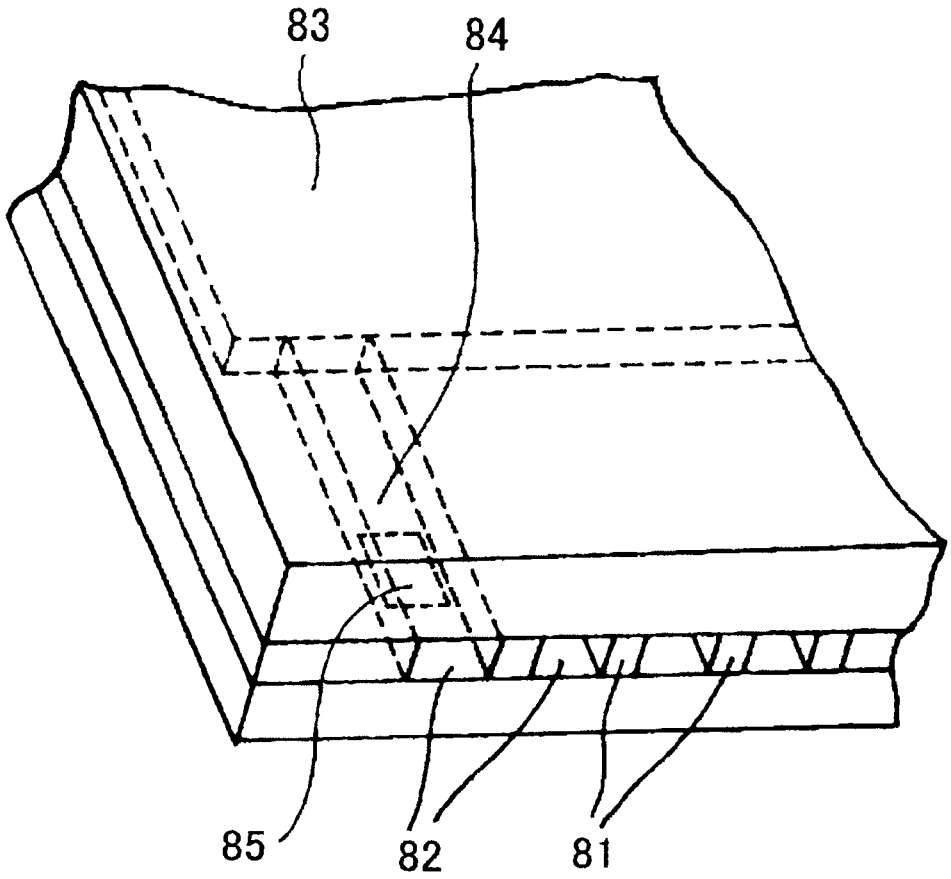
FIG. 2 is a partial perspective view schematically depicting a structure of eject portion of the recording head.

FIG. 2 is the partial perspective view schematically depicting a structure of eject portion of the recording head. A plurality of eject ports 82 are formed by a predetermined pitch on eject port surface 81 facing against the medium to be recorded by a predetermined gap (for example, ca. 0.2 to ca. 0.3 mm). Electro-thermal energy conversion modules (exothermic resistance modules, heaters) 85 for generating energy to eject ink are arranged along walls of respective liquid paths 84 communicating a common liquid chamber 83 and respective eject ports 82 together. The recording head 201 is mounted on the carriage 203 in a way where a row of eject ports is positioned so as to cross a main scanning direction (a moving direction of the recording head and carriage). When electro-thermal energy conversion modules are driven (applied electricity), inks in liquid paths 84 are brought to a film boiling and are ejected from eject ports 82 by generated pressure from the film boiling.

Figure 3:
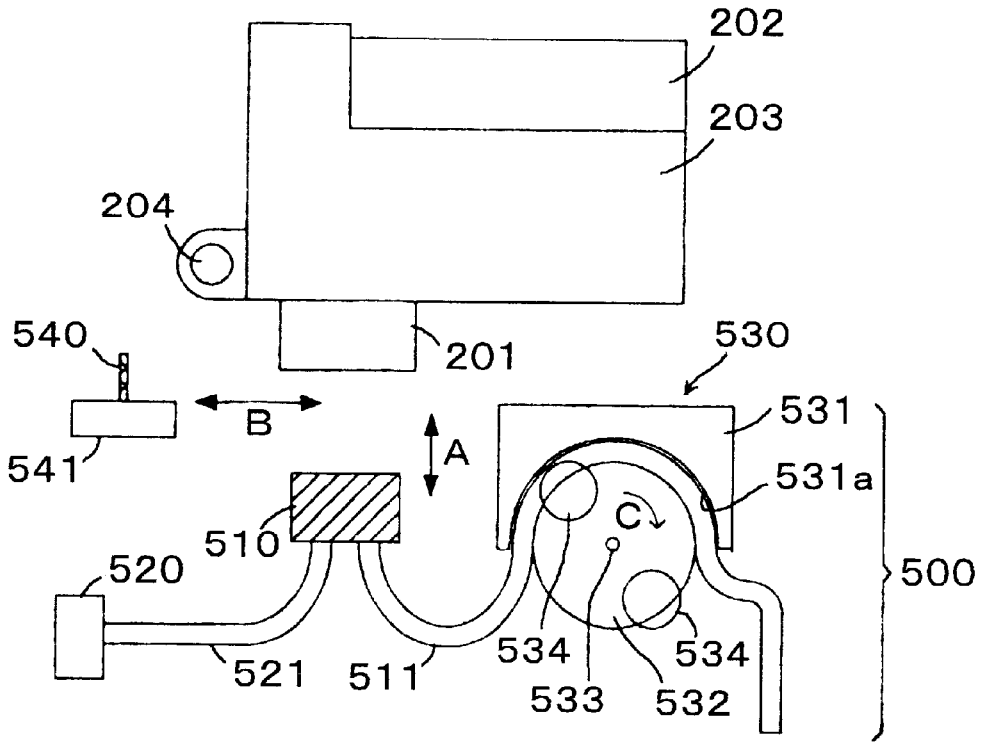
FIG. 3 is a schematic view of an embodiment of recovery units of the ink-jet printer according to the present invention.

FIG. 3 is the schematic view showing an arrangement of the recovery unit 500 of the ink-jet printer shown in FIG. 1.

In FIG. 3, a reference numeral "204" is a bearing member of the carriage 203 for fitting to the scanning rail 360. A reference numeral "510" is a cap for covering the eject port surface of the recording head capable of moving in directions depicted by a bi-directional arrow "A". The cap 510 is constituted such that when being raised by an elevating mechanism (not shown in FIG. 3) it is attached closely to the eject port surface, and when being lowered it is detached from the eject port surface. A reference numeral "511" is a sucking tube communicated to the cap, a reference numeral "521" is a communicating tube to the atmosphere communicated to the cap and a reference numeral "520" is a communicating valve to the atmosphere, connected to the communicating tube 521. The communicating valve is capable of being opened/closed by a cam mechanism (not shown in FIG. 3). A reference numeral "530" is a sucking pump formed as a tube pump. A reference numeral "531" is a pump base and a tube guide surface 531*a* is formed semi-circularly along the inside of the pump base. A reference numeral "532" is a roller holder where two rollers 534 are moved as ironing the sucking tube in accordance with a rotation of the roller holder around a rotating axis 533 so that a negative pressure is caused inside the cap 510. A reference numerals "540" and "541" are respectively a blade and a blade holder holding the blade arranged such that the blade 540, as being attached to the eject port surface, can wipe ink and foreign particles such as paper powder etc. remaining on the eject port surface by sliding the blade holder in directions depicted by a bi-directional arrow "B", while the cap 510 is moved downward to a standby position.

Figure 4:
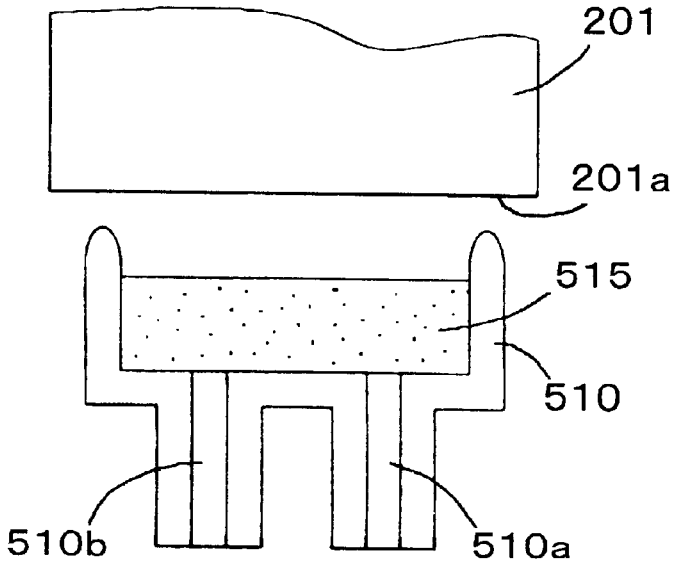
FIG. 4 is a partially enlarged sectional view of a cap portion.

FIG. 4 is the enlarged sectional view around the cap 510 for explaining its arrangement. The cap 510 is arranged so as to face an eject port surface 201*a* of the recording head 201. The cap 510 is equipped with a communicating port 510*a* for sucking, connected to the sucking tube 511. A reference character "510*b*" is a communicating port to the atmosphere connected to the communicating tube 521 to the atmosphere. A porous absorbent 515 is arranged inside the cap 510.

Figure 5:
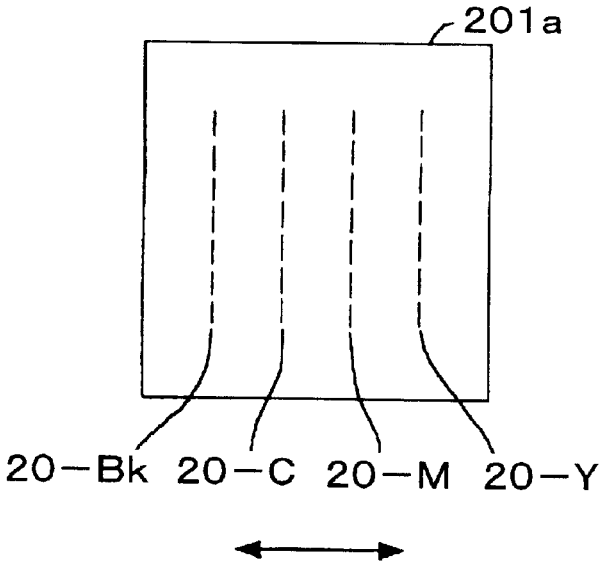
FIG. 5 is a schematic diagram for explaining the eject port surface of the recording head.

FIG. 5 is the explanatory diagram depicting the eject port surface of the recording head. In this figure nozzle rows 20-Bk, 20-C, 20-M and 20-Y for respective colors (black, cyan, magenta and yellow) are arranged perpendicularly to scanning directions of the carriage 203 depicted by a bi-directional arrow. In the present embodiment, the cap 510 is attached closely to the eject port surface 201*a* so as to cover nozzle rows of four colors simultaneously. Nozzle arrangements in the recording head 201 are not limited to arrangement mentioned above.

Figure 6:
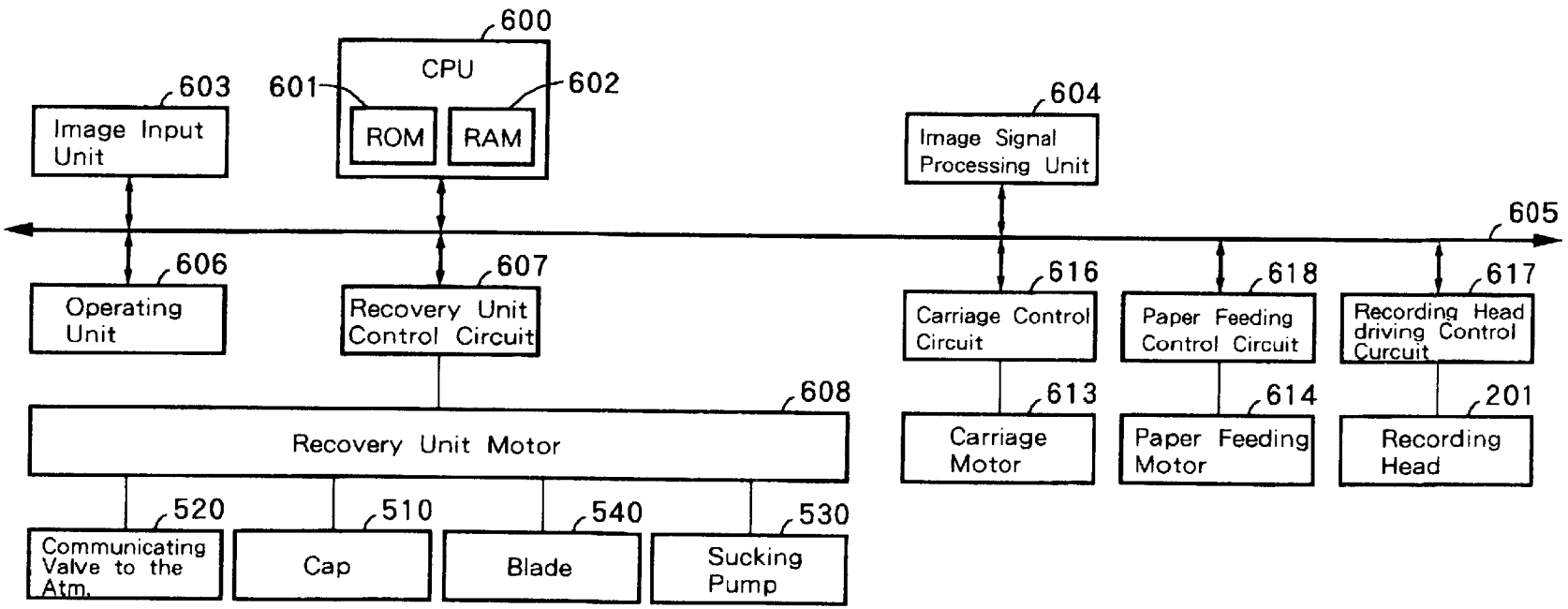
FIG. 6 is a block diagram showing an arrangement of the ink-jet recording apparatuses according to the present invention.

FIG. 6 is the block diagram depicting a configuration of the ink-jet recording apparatuses according to the present invention.

On the whole the configuration in FIG. 6 is classified into two processing groups respectively connected to a main bus line 605, namely, a software processing group comprising an image inputting unit 603, an image signal processing unit 604 and a central processing unit (CPU) 600, and a hardware processing group comprising an operating unit 606, a recovery unit controlling circuit 607, a carriage controlling circuit 616, a recording head controlling circuit 617 and a paper feeding controlling unit 618. The central processing unit 600 has a program ROM 601 in which controlling programs are stored and a random access memory (RAM) 602 in which data such as data for printing etc. are stored, so as to transmit proper recording parameters to the carriage controlling circuit 616, the paper feeding controlling circuit 618 and the recording head controlling circuit 617, so that a carriage motor 613, a paper feeding motor 614 and the recording head 201 are respectively driven for executing recording operations. A program for executing recovery operations depicted by a timing chart in FIG. 7, which will be described later, is also stored in the ROM 601 so as to execute recovery operations by transmitting controlling parameters to the recovery unit controlling circuit 607 and the recording head controlling circuit 617, if required (for example, an instruction from the operating unit 606 for executing a sucking recovery operation). The recovery unit controlling circuit 607 drives a recovery unit motor 608 so as to activate the cap 510, the communicating valve 520 to the atmosphere, the blade 540 and the sucking pump 530. The recording head controlling circuit 617 drives electro-thermal energy conversion modules arranged in the recording head 201 for ejecting ink during printing operations and pre-ejection. By driving the above-mentioned controlling circuits, a series of recovery operations, which are explained hereinafter, can be executed.

Figure 7:
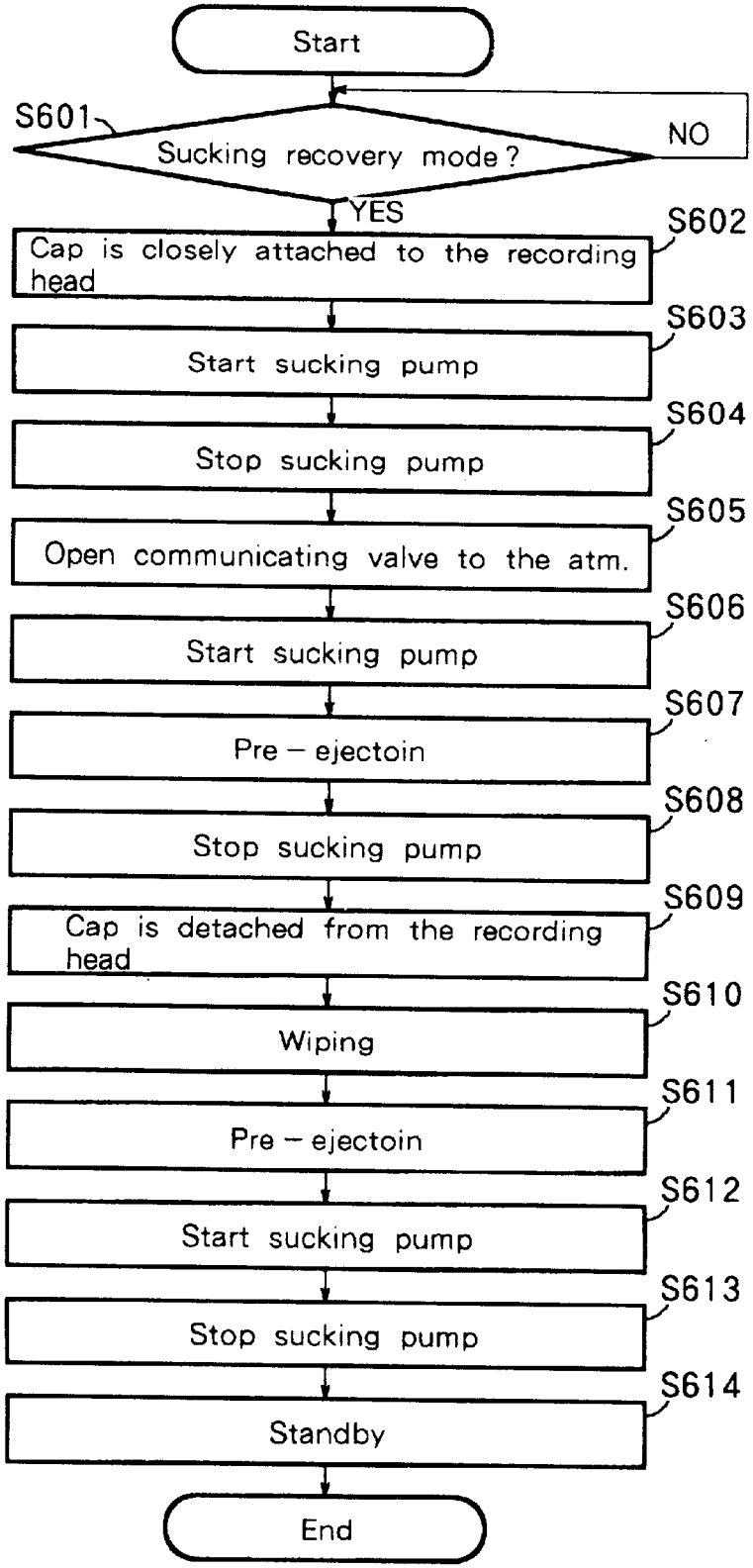
FIG. 7 is a flow chart showing a series of recovery operations according to one of the embodiments.
Figure 8:
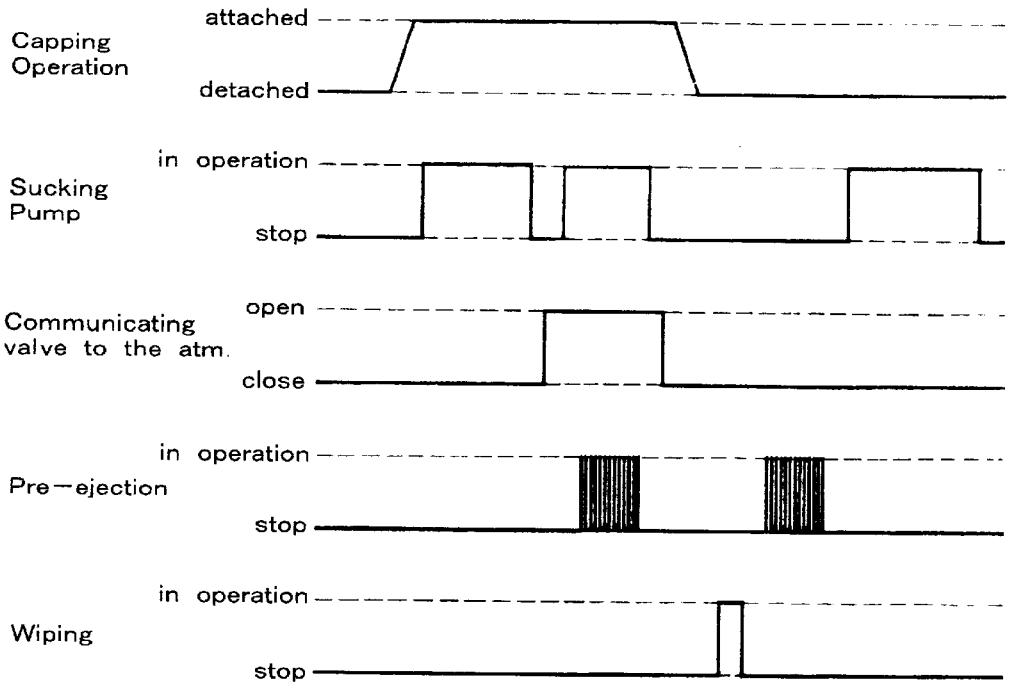
FIG. 8 is a time chart for explaining a series of recovery operations.

FIG. 7 is the flow chart showing a series of recovery operations according to the present embodiment and FIG. 8 is the time chart for explaining a series of recovery operations. Hereinafter a series of sucking operations according to the present embodiment are explained by referring to FIGS. 7 and 8.

At step S601 a mode is identified whether an instruction to execute the sucking recovery operation or not. If identified as the sucking recovery mode, a status of the sucking operation goes to step S602. The carriage 203 is moved to a position over the cap 510 (the home position) and cap 510 is raised and attached closely to the eject port surface 201*a* of the recording head 201. At this step the communicating valve 520 to the atmosphere is still closed and sucking is started (step S603) by rotating the sucking pump 530 as the communicating valve 520 is being closed. The negative pressure is caused inside the cap 510 by rotating rollers 534 by a predetermined extent so that ink is sucked from inside of the recording head 201 via nozzles arranged in the recording head 201. Then the sucking pump 503 is stopped (step S604) and the communicating valve 520 is opened (step S605) by communicating the inside of the cap 510 to the atmosphere so as to return a pressure inside the cap 510 to the atmospheric pressure. The sucking operation is started again by rotating rollers 534 of the sucking pump 530 (step S606). At this step according to a transmitted ejecting instruction to the recording head, the pre-ejection is executed to eject ink from the recording head 201 by rotating the sucking pump 530 as the cap 510 is covering the recording head (step S607). Sucked ink from the cap 510 as well as ejected ink from the recording head 201 is removed out of the cap. When ink is removed from the absorbent 515 arranged in the cap 510 positioned closely to the recording head 201, the absorbent 515 recovers its absorbing ability. Consequently, since the absorbent 515 can absorb, i.e. remove remaining ink droplets stuck to the eject port surface 201*a* of the recording head 201 and the absorbent also removes ink droplets ejected from the recording head 201, ink once ejected from nozzles can be effectively prevented from flowing into the nozzles again. Since the cap 510 covers and attaches to the recording head during the pre-ejection, mist is kept from leaking out of the cap 510. When the pre-ejection is finished, the sucking pump 530 is stopped (step S608) and the cap 510 is detached from the eject port surface 201*a* as lowering the cap 510 (step S609). After the cap 510 is lowered completely, the blade holder 541 is moved slidably so as to wipe the eject port surface 201*a* of the recording head 201 with the blade 540 (step S610) so that the remaining ink on the eject port surface 201*a* is removed. Ink is pre-ejected again in order to remove ink pushed into nozzles during the wiping on the eject port surface 201*a* with the blade 540 (step S611). Since the pre-ejection at step S607 is not executed in conventional cases, the mixed ink is ejected only at this step S611. On the other hand, since the pre-ejection at step S607 is added in the present invention, the mixed color is prevented even a less amount of ink is consumed in the pre-ejection. The pre-ejection after the wiping operation may be executed at a specified position or the capping position where ink is ejected into the cap 510. The pre-ejection at the capping position can realize a more compact recording apparatus, since the specified position for the pre-ejection is not required. Ink in the cap 510 may be removed by rotating rollers 534 of the sucking pump 530 again as the cap 510 is being detached from the recording head (step S612). When the sucking operation is stopped (step S613) a series of sucking operations are finished and go to a standby status (step S614).

In FIG. 8 above-explained operating statuses of the cap (attached or detached to the recording head), the sucking pump (sucking or standby), the communicating valve to the atmosphere (open or close), the pre-ejection (driven or standby) and the blade (driven or standby) are depicted in accordance with elapsed time.

In the present embodiment the opening operation of the communicating valve to the atmosphere is executed as the cap is being attached closely to the recording head after the sucking pump is temporally stopped, but the operation is not limited in the way described above. An arrangement where the communicating valve is opened as the sucking operation is being executed, can be employed.

In the present embodiment a series of sucking operations for one cap configuration are described for explaining more clearly, but sucking operations can be executed either in a plurality of caps respectively or in one of a plurality of caps.

In the present embodiment a series of sucking operations executed by the tube pump are described, but sucking operations are not limited to this pump configuration. Any pumps capable of generating the negative pressure in the cap may be employed in the present invention.

Figure 9:
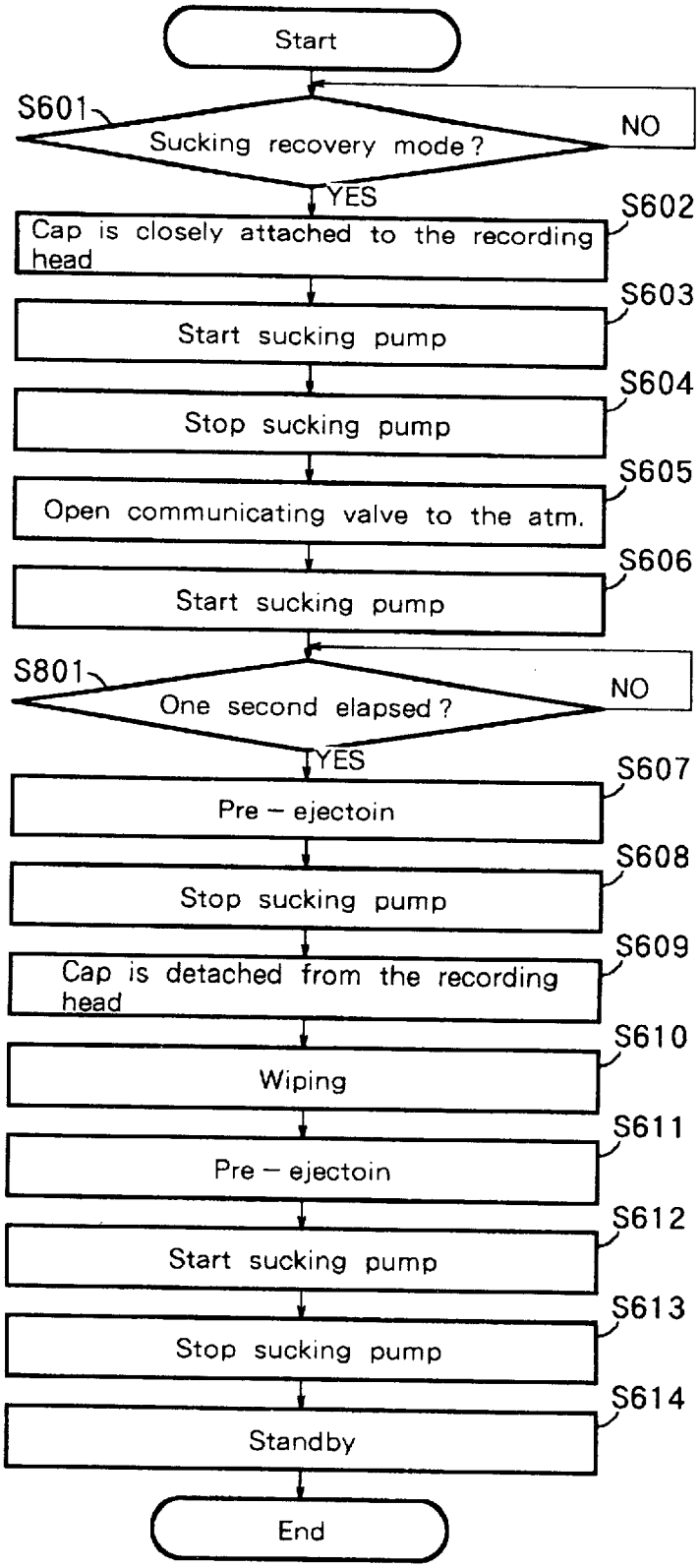
FIG. 9 is a flow chart showing a series of recovery operations according to the other embodiment.

FIG. 9 is the flow chart showing a series of recovery operations according to the other embodiment. The same reference characters in FIG. 9 as in FIG. 7 are not explained again.

As shown in FIG. 9, the pre-ejection is started after the sucking pump is started as the communicating valve 520 to the atmosphere connected to the cap 510 is being opened and after a predetermined time is elapsed. Through our experiments, the following fact is confirmed. The pre-ejection started ca. one second after the sucking operation is started (step S801), is more effective in alleviating the mixed color than the pre-ejection immediately after the sucking is started as the communicating valve is being opened to the atmosphere and the same amount of ink is ejected in both cases. In the case of the pre ejection immediately after the sucking is started, pre-ejection is supposed to be not too effective, because the ink ejection from the recording head 201 is disturbed by a fairly amount of stuck ink to the eject port surface 201*a*.

In the present embodiment the elapsed time after the sucking is started as the communicating valve is being open to the atmosphere, is set one second, but it is not limited to this value. Since the mixed color might flow further into nozzles due to too long elapsed time, the time is preferably set between 0.5 to 2.0 seconds.

As explained above, effect to obtain recording with high quality is attained by effectively preventing the mixed color caused by the sucking operation according to the present invention. More specifically, since the ink is ejected (pre-ejected) from the recording head while ink in the cap is removed by the sucking pump as the inside of the cap is being communicating to the atmosphere and as the cap is kept being attached to the recording head, the mixed ink in the recording head can be immediately discharged from the recording head and amount of ejected ink for preventing the mixed color can be reduced.

What is claimed is:

1. An eject recovery method comprising steps of:

a first step for performing suction from a first eject port for ejecting first ink and a second eject port for ejecting second ink different from the first ink through a cap for capping said first eject port and said second eject port while said cap is capping said first eject port and said second eject port collectively; and a second step for communicating an inside of said cap to atmosphere while said cap is capping said first eject port and said second eject port, and then performing suction from said cap while the inside of said cap communicates to atmosphere and while said cap is capping said first eject port and said second eject port, and concurrently ejecting ink into said cap from said first eject port and said second eject port.

2. The eject recovery method according to claim 1, wherein said first ink and said second ink are different in colors.

3. The eject recovery method according to claim 1, further comprising a third step for releasing said capping status by said cap after said second step.

4. The eject recovery method according to claim 3, further comprising a fourth step for sucking from said cap while said capping status by said cap is being released after said third step.

5. The eject recovery method according to claim 1, wherein the ink ejection into said cap starts after a predetermined time elapses after the sucking from said cap starts during said second step.

6. An ink-jet recording apparatus comprising:

a cap for capping a first eject port for ejecting first ink and a second eject port for ejecting second ink different from said first ink collectively, and equipped with a communicating valve to atmosphere;

a sucking means for performing suction while said cap is capping said ink eject ports; and a control means for causing said sucking means to perform suction from said first eject port and said second eject port through said cap while said cap is capping said first eject port and said second eject port collectively, then causing said valve to communicate an inside of said cap to atmosphere while said cap is capping said first eject port and said second eject port, and thereafter causing said sucking means to perform suction from said cap while the inside of said cap communicates to atmosphere and while said cap is capping said first eject port and said second eject port and concurrently ejecting ink into said cap from said first eject port and said second eject port.

7. The ink-jet recording apparatus according to claim 6, wherein said first ink and said second ink are different in colors.

8. The ink-jet recording apparatus according to claim 6, wherein said control means starts ejecting ink into said cap after a predetermined time elapses after the sucking from said cap starts.

9. The ink-jet recording apparatus according to claim 6, wherein an absorbent is arranged inside said cap.

10. The ink-jet recording apparatus according to claim 6, wherein electro-thermal converting bodies for generating thermal energy to be utilized to eject ink are arranged corresponding to respective said first eject port and said second eject port.

* * * * *

UNITED STATES PATENT AND TRADEMARK OFFICE

CERTIFICATE OF CORRECTION

PATENT NO. : 6,648,447 B2
DATED : November 18, 2003
INVENTOR(S) : Sugimoto et al.

It is certified that error appears in the above-identified patent and that said Letters Patent is hereby corrected as shown below:

Drawings:
Sheet 6, Fig. 7, Steps S607 and S611, "Pre-ejectoin" should read -- Pre-ejection --.
Sheet 8, Fig. 9, Steps S607 and S611, "Pre-ejectoin" should read -- Pre-ejection --.

Column 2,
Line 7, "mix each" should read -- mix with each --.
Line 12, "nozzles. Which" should read -- nozzles, which --.
Line 41, "fairly" should read -- fair --.

Column 3,
Line 15, "cap communicating" should read -- cap is communicating --.

Column 4,
Line 52, "above" should read -- above, --.

Column 5,
Line 41, "A reference" should read -- Reference --.
Line 45, "powder etc." should read -- power, etc., --.
Line 59, "figure" should read -- figure, --.

Column 6,
Line 4, "whole" should read -- whole, --.
Line 15, "printing etc." should read -- printing, etc., --.
Line 41, "Hereinafter" should read -- Hereinafter, --.

Column 7,
Line 39, "In FIG. 8" should read -- In. FIG. 8, the --.
Line 48, "temporally" should read -- temporarily --.

UNITED STATES PATENT AND TRADEMARK OFFICE

CERTIFICATE OF CORRECTION

PATENT NO. : 6,648,447 B2
DATED : November 18, 2003
INVENTOR(S) : Sugimoto et al.

It is certified that error appears in the above-identified patent and that said Letters Patent is hereby corrected as shown below:

Column 8,
Line 12, "fairly" should read -- fair --.

Signed and Sealed this

Tenth Day of August, 2004

JON W. DUDAS
*Acting Director of the United States Patent and Trademark Office*